US007140831B2

(12) United States Patent
Wollgast et al.

(10) Patent No.: US 7,140,831 B2
(45) Date of Patent: Nov. 28, 2006

(54) ATTACHMENT FOR FORMING SHAPES FOLLOWING EXCAVATION

(76) Inventors: William Orman Wollgast, 18511 Fisher Rd., Waller, TX (US) 77484; James Oliver Ellinwood, 2619 Shadow Brair La., Houston, TX (US) 77370

( * ) Notice: Subject to any disclaimer, the term of this patent is extended or adjusted under 35 U.S.C. 154(b) by 0 days.

(21) Appl. No.: 10/758,514

(22) Filed: Jan. 15, 2004

(65) Prior Publication Data

US 2005/0167128 A1 Aug. 4, 2005

(51) Int. Cl.
*B65G 1/00* (2006.01)

(52) U.S. Cl. ..... 414/787

(58) Field of Classification Search ..... 414/787
See application file for complete search history.

(56) References Cited

U.S. PATENT DOCUMENTS 3,028,698 A * 4/1962 Schmitt ..... 172/252
3,471,953 A * 10/1969 Wyatt ..... 37/142.5
3,523,380 A * 8/1970 Griffin et al. ..... 37/403
4,360,980 A * 11/1982 Jarvis ..... 37/404
4,698,926 A * 10/1987 Caplis et al. ..... 37/403
4,808,027 A * 2/1989 Anderson ..... 404/127
4,809,449 A * 3/1989 Solaja ..... 37/407
4,826,359 A * 5/1989 Bec et al. ..... 405/271
5,075,985 A * 12/1991 Mensch ..... 37/407
5,096,334 A * 3/1992 Plank ..... 405/283
5,398,430 A * 3/1995 Scott et al. ..... 37/142.5
5,713,418 A * 2/1998 Warren et al. ..... 172/40
5,819,444 A * 10/1998 Desmarais ..... 37/281
6,109,362 A * 8/2000 Simpson, Sr. ..... 172/375
6,139,223 A * 10/2000 Snyder ..... 405/179
6,526,678 B1 * 3/2003 Waddington, Jr. ..... 37/406

* cited by examiner

*Primary Examiner*—Christopher J. Novosad
(74) *Attorney, Agent, or Firm*—Machetta Law Firm, P.C.; Gary M. Machetta

(57) ABSTRACT

An attachment for a skid steer loader, back hoe or powered excavator that can be used to quickly smooth out the walls of a swimming pool, ditch, etc. following the excavation and the process of using the attachment. The attachment includes a vertical flat surface perpendicular to the ground for smoothing the walls of a swimming pool. The process will reduce the need for workers to spend time and effort smoothing the walls manually and improving the safety of swimming pool construction. The cost of building a swimming pool will be reduced significantly by decreasing the number of workers required in the construction process. The process of smoothing walls reduces the amount of gunite required in the swimming pool construction process and thus improving the economics for the pool builder.

6 Claims, 4 Drawing Sheets

ATTACHMENT FOR FORMING SHAPES FOLLOWING EXCAVATION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING" A TABLE, OR A COMPUTER PROGRAM LISTING APPENDIX SUBMITTED ON A COMPACT DISC

Not Applicable

FIELD OF THE INVENTION

This invention pertains to an attachment for forming shapes following excavation. More particularly, this invention pertains to an attachment for vehicles such as skidsteer loaders, back hoes, etc. which can be used in the construction of swimming pool walls, ditches, sidewalks, etc. where curved shapes are required.

DESCRIPTION OF RELATED ART

The use of attachments on skidsteer loaders, backhoes and powered excavating equipment to aid in performing various tasks is known. During the excavation of a swimming pool, it is common to use a skidsteer because of its smaller size and maneuverability. Many swimming pools are excavated using a skidsteer and a standard bucket attachment. Skidsteer loaders with a standard bucket attachment are used to remove dirt from a hole in constructing a swimming pool. However, the standard bucket used on skidsteer loaders or back-hoes leave the walls to a swimming pool requiring significant smoothing out or leveling. This smoothing out process is performed manually by workers using shovels. This manual process of smoothing out the walls is time consuming, requires much effort and is costly. In addition, some areas of the country are very rocky and this adds to the difficulty in manually smoothing out the walls.

BRIEF SUMMARY OF THE INVENTION

This present invention is an attachment for vehicles such as skidsteer loaders, back hoes and powered excavators that can be used to quickly smooth out the walls of a swimming pool following the excavation and prior to the steel reinforcement phase. The attachment is connected to the vehicle by using the cotouts and clamping mechanism and transported to the wall of the swimming pool. The attachment is then lifted and placed in contact with the top of the wall of the swimming pool. The attachment is then lowered to the bottom of the wall of the swimming pool making contact with the wall. The invention quickly smoothes the wall surface of the swimming pool by knocking the dirt and other items to the ground or by cutting any tree limb, rock, etc. that may be in contact with the invention by contacting a beveled edge. The process of raising and lowering the attachment while making contact may be repeated as necessary to flatten the surface.

This invention significantly reduces and may even eliminate the need for workers to spend time and effort smoothing the walls. This invention significantly reduces the time required to prepare the walls of a swimming pool, ditch, sidewalk, etc. for the steel reinforcement stage. In addition, this invention improves the safety of swimming pool construction by eliminating the exposure of workers to an operating skidsteer loader in the limited swimming pool area.

This invention reduces the costs of building a swimming pool by reducing the number of workers required in the construction process. In addition, the use of the invention will reduce the amount of gunite required in the swimming pool construction process due to the smoothness of the resulting walls.

BRIEF DESCRIPTION OF THE SEVERAL VIEWS OF THE DRAWING(S)

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiment set forth herein; rather, these embodiments are provided so that this disclosure will be thorough and complete, and will fully convey the scope of the invention to those skilled in the art. Like numbers refer to like elements throughout.

Figure 1:
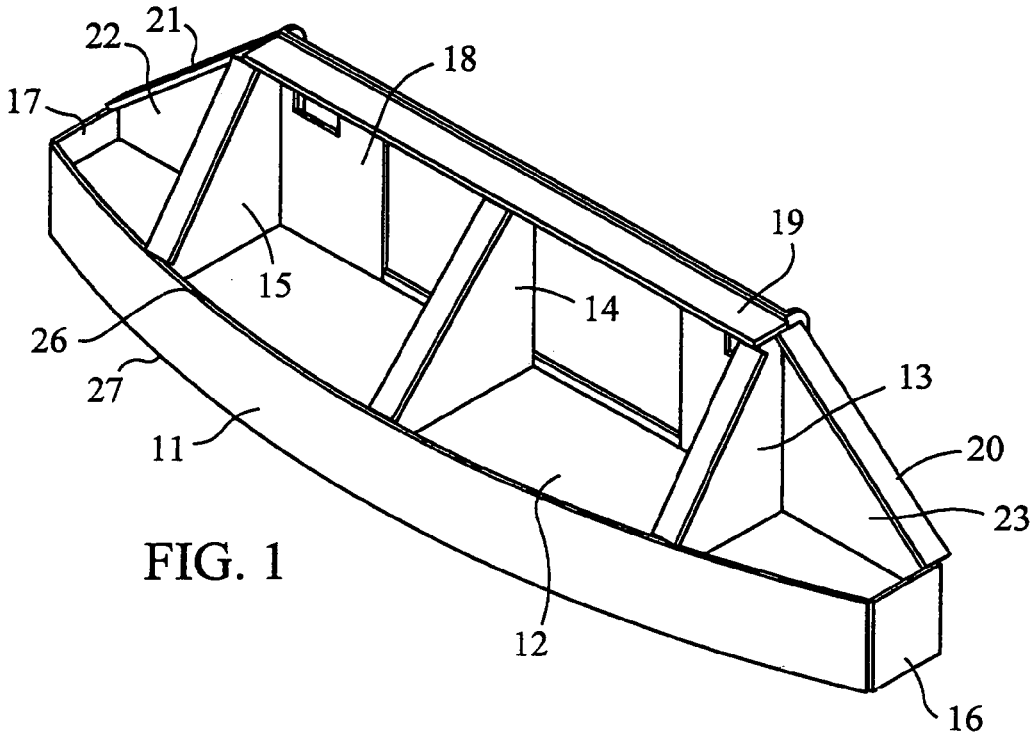
FIG. 1 is a front perspective view from a slightly elevated view according to one embodiment of the instant invention.

With reference to the drawings, FIG. 1 illustrates an attachment according to the instant invention. As illustrated, the attachment includes a curved front surface 11 with beveled edges attached to a base 12. In addition, three support structures 13, 14, and 15 are attached on top of the base 12 and in contact with the curved front surface 11 and the connecting frame 18. A flat surface 19 is connected directly on top of the support structures 13, 14 and 15. The sides 16 and 17 are connected to the base 12, curved front surface 11, the walls 22 and 23 and the covers 20 and 21. The drawing illustrates an attachment with both a top beveled edge (26) and bottom beveled edge (27). The invention can have either edge. The curved front surface can have a concave or convex shape with radius ranges from 2 to 24 feet.

Figure 2:
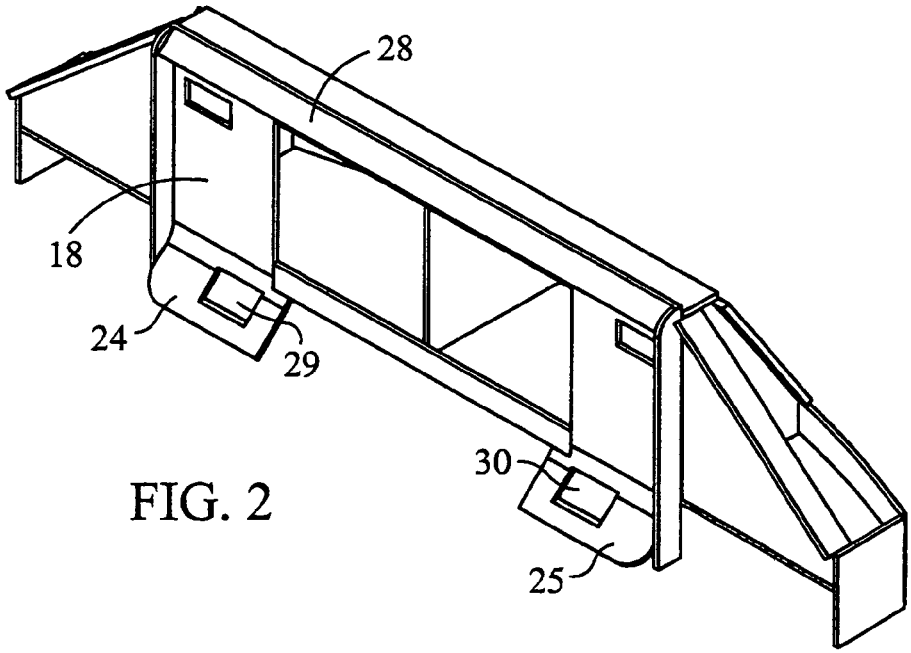
FIG. 2 is a rear perspective view of the attachment shown in FIG. 1.

FIG. 2 shows the connecting frame 18 with 2 large cutouts as well as 2 extensions 24 and 25 with rectangular cutouts for the insertion of the arms of a vehicle, for example a skid steer loader. The extensions 24 and 25 are angled to assist the connection with a vehicle. The clamping mechanism 28 is shown. Also, the cutouts 29 and 30 are shown.

Figure 3:
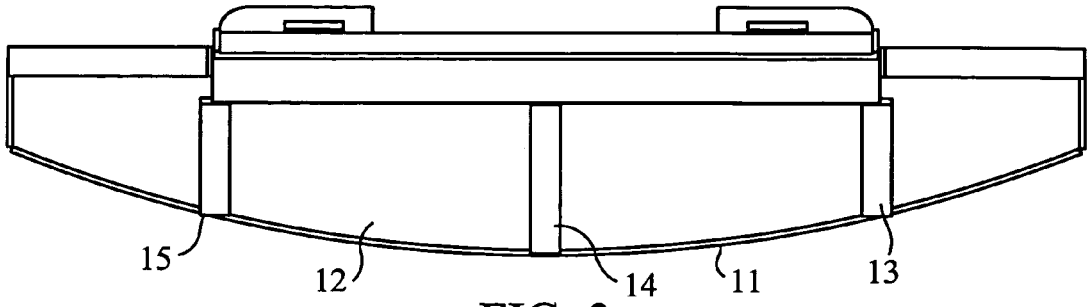
FIG. 3 is an overhead plan view of the attachment shown in FIG. 1.

FIG. 3 shows the curved front surface 11 that makes contact with the wall of the swimming pool, ditch, etc. and forms the smoothed out walls. The base 12 is where dirt may accumulate as the invention is lowered to the bottom surface of the swimming pool wall. Support structures 13, 14 and 15 are shown from an overhead view.

Figure 4:
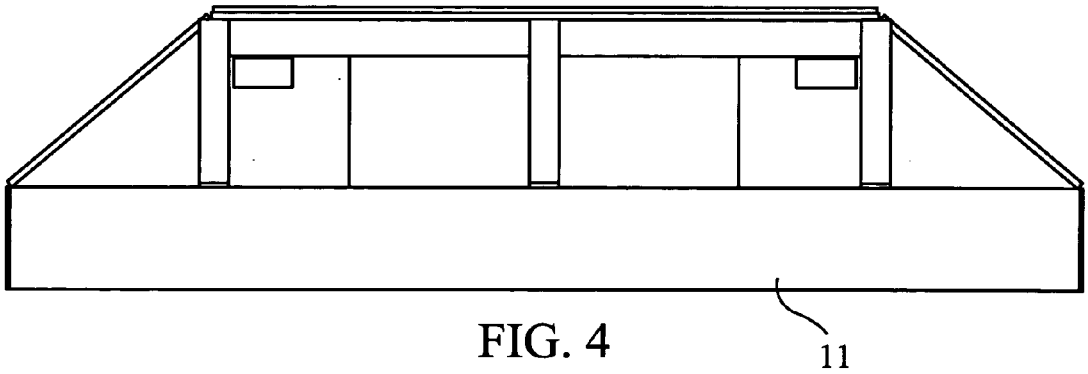
FIG. 4 is a front perspective view of the attachment shown in FIG. 1 from the same elevation.

FIG. 4 is a front perspective view of the attachment. The curved front surface 11 makes direct contact with the swimming pool walls.

Figure 5:
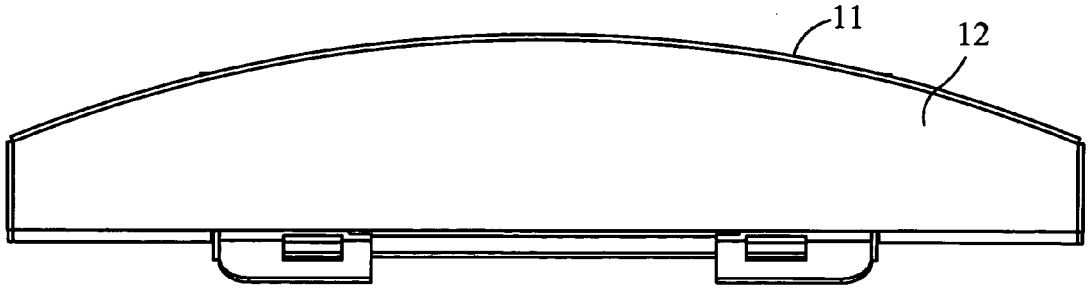
FIG. 5 is a bottom perspective view of the attachment shown in FIG. 1.

FIG. 5 is a bottom perspective. The curved front surface 11 as well as the base 12 are shown.

Figure 6:
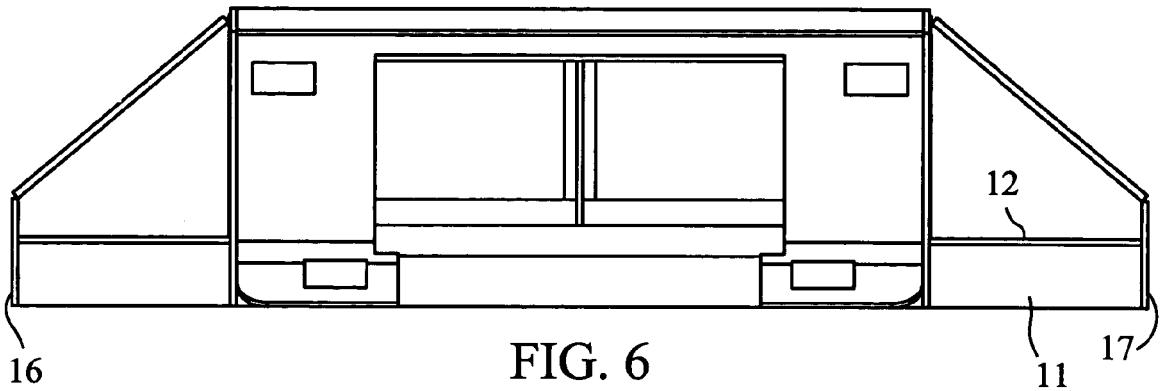
FIG. 6 is a rear perspective view of the attachment shown in FIG. 1 from the same elevation.

FIG. 6 is a rear perspective view that shows the vertical location of the base 12 relative to the curved front surface 11 and the sides 16 and 17. This vertical distance allows the invention to collect dirt at the bottom of the swimming pool after being lowered and to drag the dirt for collection or to be spread along the swimming pool bottom.

Figure 7:
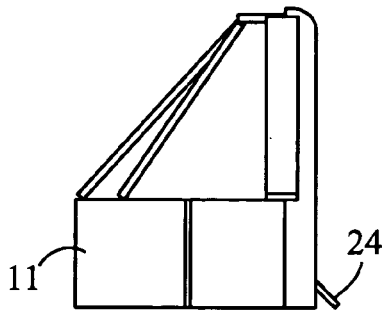
FIG. 7 is a side plane view of the attachment shown in FIG. 1.

FIG. 7 shows a side plane view of the attachment and shows how the extension 24 is angled toward where the skidsteer loader is inserted. Also, the curved front surface 11 is shown.

Figure 8:
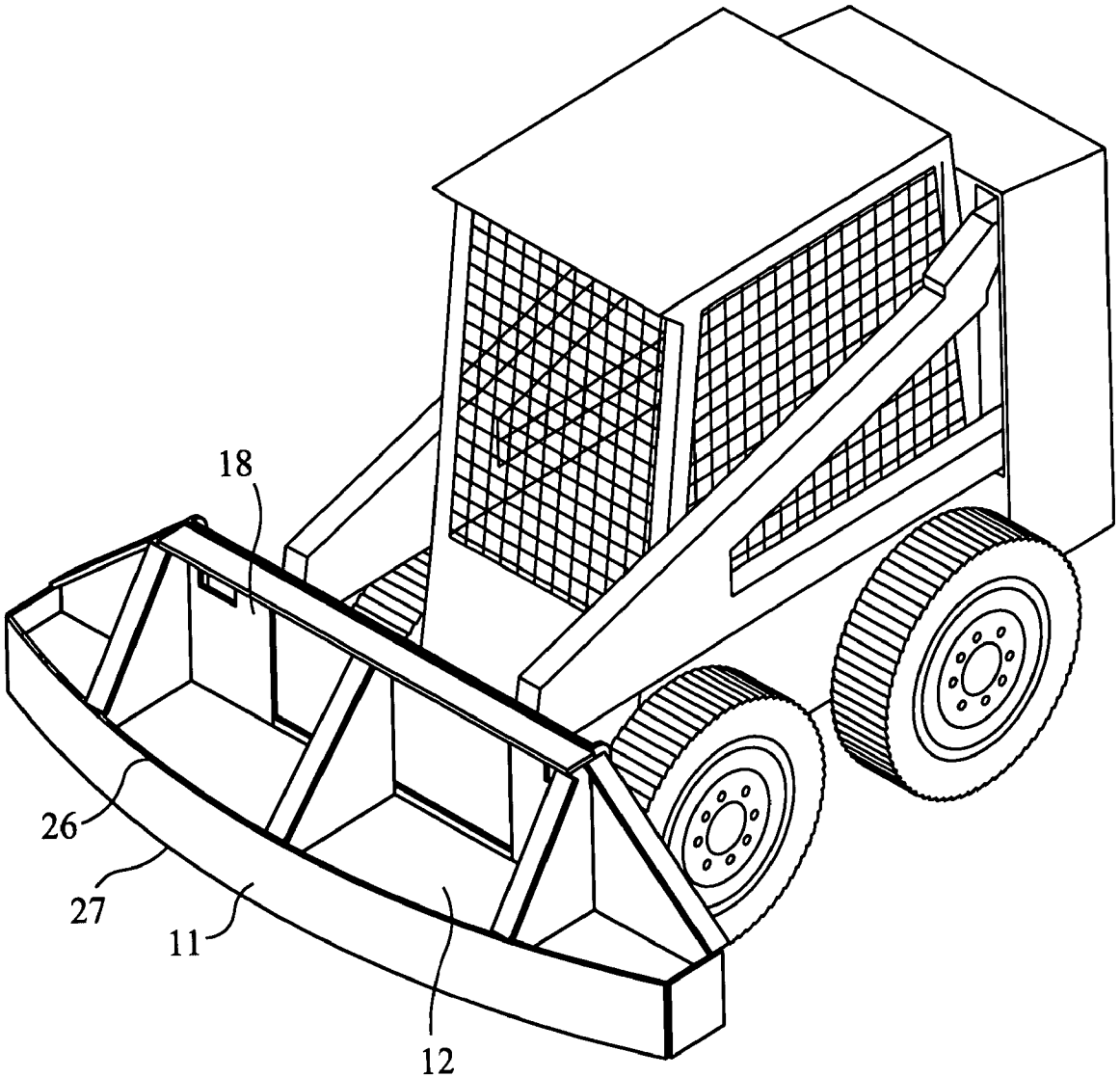
FIG. 8 is an environmental view illustrating a conventional skidsteer loader with the present invention attached.

FIG. 8 illustrates a conventional skidsteer loader attached to the invention. The connecting frame 18 is against the skidsteer loader and curved front surface 11 is directed toward the swimming pool wall or ditch wall. The base 12 is parallel to the ground. The drawing shows a top beveled edge (26) and bottom beveled edge (27). The invention can be with either edge.

The invention claimed is:

1. An attachment for securing to a skid steer loader having;

A connecting frame allowing for the connection to a skid steer loader;

a base connected perpendicular to said connecting frame and near the bottom so that the base is directed just above the skid steer loader's connecting point providing support when the attachment is connected to the skid steer loader;

a front surface perpendicular to said base;

said front surface connected to the end of the base opposite the connecting frame and vertically such that the front surface extends above and below the base and said front surface includes a surface for cutting located at the top of the front surface at a distance furthest from the ground; and a support structure connected between said connecting frame and said base to provide strength to the attachment.

2. An attachment according to claim 1, wherein said front surface is shaped with radius ranges from 4 to 16 feet.

3. An attachment according to claim 1, wherein said front surface is shaped with radius ranges from 7 to 9 feet.

4. An attachment according to claim 1, wherein said front surface is shaped with radius ranges from 7 to 9 feet; said connecting frame having two extensions located below the base and a clamping mechanism; and said extensions having cutouts.

5. An attachment according to claim 1, wherein said front surface is shaped with radius ranges from 7 to 9 feet.

6. An attachment according to claim 1, wherein said front surface is shaped with radius ranges from 7 to 9 feet;

said connecting frame having two extensions located below the base and a clamping mechanism; and said extensions having cutouts.

* * * * *